US012551070B2

(12) United States Patent
Xia et al.

(10) Patent No.: US 12,551,070 B2
(45) Date of Patent: Feb. 17, 2026

(54) DUST COLLECTING DEVICE, CLEANING BASE STATION AND ROBOT CLEANING SYSTEM

(71) Applicants: ZHEJIANG MIYUE TECHNOLOGY CO., LTD, Zhejiang (CN); Zhejiang Sineva Intelligent Technology Co., Ltd., Zhejiang (CN)

(72) Inventors: Changtai Xia, Zhejiang (CN); Guangzhi Cong, Zhejiang (CN); Zengfei Wang, Zhejiang (CN)

(73) Assignees: ZHEJIANG MIYUE TECHNOLOGY CO., LTD, Haining (CN); ZHEJIANG SINEVA INTELLIGENT TECHNOLOGY CO., LTD., Haining (CN)

( * ) Notice: Subject to any disclaimer, the term of this patent is extended or adjusted under 35 U.S.C. 154(b) by 522 days.

(21) Appl. No.: 18/163,495

(22) Filed: Feb. 2, 2023

(65) Prior Publication Data

US 2023/0414050 A1 Dec. 28, 2023

(30) Foreign Application Priority Data

Jun. 28, 2022 (CN) ..... 202210746224.1

(51) Int. Cl.
*A47L 9/14* (2006.01)
*A47L 9/00* (2006.01)

(52) U.S. Cl.
CPC ..... *A47L 9/149* (2013.01); *A47L 9/0063* (2013.01); *A47L 2201/024* (2013.01)

(58) Field of Classification Search
CPC ..... A47L 9/00; A47L 9/10; A47L 9/14; A47L 9/149; A47L 9/0063; A47L 11/40; A47L 11/4091; A47L 2201/02; A47L 2201/024
See application file for complete search history.

(56) References Cited

FOREIGN PATENT DOCUMENTS

| | | | | |
|---|---|---|---|---|
| CN | 112137510 A | | 12/2020 | |
| CN | 213075543 U | * | 4/2021 | ..... A47L 11/40 |
| KR | 102161708 B1 | * | 10/2020 | ..... A47L 9/00 |

OTHER PUBLICATIONS

Decision on Rejection (including English machine translation) in corresponding CN 202210746224.1; Dated: May 30, 2024, (10 pp).

(Continued)

*Primary Examiner* — C. A. Rivera
(74) *Attorney, Agent, or Firm* — Myers Bigel, P.A.

(57) ABSTRACT

Provided are dust collecting device and cleaning base station. The dust collecting device includes machine shell, cover body, air duct structure, rotating support and dust bag. Accommodating cavity is formed in the machine shell, opening communicated with accommodating cavity is provided on the machine shell, the cover body is movably connected with the machine shell for closing the opening, and pushing component is arranged on the cover body. The air duct structure is provided in the machine shell, dust outlet thereof is communicated with accommodating cavity, the rotating support is provided in accommodating cavity, one end thereof is rotating fulcrum, and the dust bag is located in accommodating cavity and installed on the rotating support. When the cover body closes the opening, the pushing component drives the rotating support to rotate around the rotating fulcrum thereof, so that part of the dust outlet is located in the dust bag.

10 Claims, 12 Drawing Sheets

(56) References Cited

OTHER PUBLICATIONS

First Office Action (including English machine translation) in corresponding CN 202210746224.1; Dated: Sep. 4, 2023, (14 pp).
Second Office Action (including English machine translation) in corresponding CN 202210746224.1; Dated: Jan. 29, 2024, (15 pp).

* cited by examiner

DUST COLLECTING DEVICE, CLEANING BASE STATION AND ROBOT CLEANING SYSTEM

CROSS-REFERENCE TO RELATED APPLICATIONS

The present application claims priority to Chinese Patent Application No. 202210746224.1, entitled "Dust Collecting Device and Cleaning Base Station", filed with China National Intellectual Property Administration on Jun. 28, 2022, the entire content of which is incorporated herein by reference.

TECHNICAL FIELD

The present disclosure relates to the technical field of cleaning equipment, and in particular, to a dust collecting device, a cleaning base station and a robot cleaning system.

BACKGROUND ART

With the continuous development of science and technology and the improvement of people's living standards, smart homes are gradually integrated into people's lives. At present, cleaning robots have become one of the common smart home appliances, and are more and more favored by people. On the one hand, cleaning robots can perform a large amount of cleaning work in a short period of time, thereby improving cleaning efficiency; on the other hand, cleaning robots can free people from tedious housework and bring great convenience to people.

Most of the cleaning robots on the market are basically equipped with a vacuuming function, that is, negative pressure is generated by the high-speed operation of the exhaust fan, so as to absorb the dust and dirt on the ground into the dust box, thereby achieving the effect of cleaning the ground. When the dust box is full of dust, it is necessary to perform dust recovery through the dust collecting barrel of the cleaning base station, so as to empty the dust and dirt in the dust box of the cleaning robot, so that the cleaning robot can continue the cleaning operation.

The existing dust collecting barrel generally includes an air duct and a dust bag. One part of the air duct is a fixed air duct, and the other part is a movable air duct. The movable air duct can be rotated around a certain rotating shaft, and communication and sealing with the fixed air duct are always maintained during the rotation process. After the dust bag is put into the dust collecting barrel, the movable air duct is driven to rotate by a specific mechanical device, so that the movable air duct extends into the inside of the dust bag, so as to realize the sealing effect.

However, although the existing dust collecting barrel can solve the problem of dust recovery, it also has some defects. On the one hand, the movable air duct will occupy a larger moving space during the rotation process, which causes the occupiable space of the dust bag to become smaller; on the other hand, it is difficult to ensure the airtightness between the movable air duct and the fixed air duct, which increases the difficulty of design.

In view of this, the present disclosure aims to design a dust collecting device with a simplified structure and high space utilization, which is applied in cleaning base station, so as to realize the recovery of dust.

SUMMARY

In view of this, the purpose of the present disclosure is to overcome the deficiencies in the prior art, and provide a dust collecting device and a cleaning base station, so as to solve the technical problems that the space occupied by the movable air duct is larger and the tightness between the movable air duct and the fixed air duct is difficult to be guaranteed in the prior art.

In order to solve the above-mentioned technical problems, the present disclosure provides:

a dust collecting device, which comprises:

a machine shell, wherein an accommodating cavity is formed in the machine shell, an opening communicated with the accommodating cavity is provided on the machine shell;

a cover body, wherein the cover body is movably connected with the machine shell for closing the opening, and a pushing component is arranged on the cover body;

an air duct structure, wherein the air duct structure is provided in the machine shell, a dust outlet of the air duct structure is communicated with the accommodating cavity;

a rotating support, wherein the rotating support is provided in the accommodating cavity, one end of the rotating support is a rotating fulcrum; and a dust bag, wherein the dust bag is located in the accommodating cavity and installed on the rotating support, wherein when the cover body closes the opening, the pushing component drives the rotating support to rotate around the rotating fulcrum, so that a part of the dust outlet is located in the dust bag to achieve the air duct structure communicating with the dust bag.

In one possible embodiment, the air duct structure comprises an air duct and a butt-jointed component, the butt-jointed component comprises a connecting part and a dust outlet pipe, and the connecting part is connected to the air duct, one side of the connecting part facing away from the air duct is an inclined plane, the dust outlet pipe is vertically provided on the inclined plane, one end of the dust outlet pipe is the dust outlet, and the other end of the dust outlet pipe is communicated with the air duct, an annular arc part is provided in a circumferential direction of the dust outlet pipe, and the dust outlet protrudes from the annular arc part, when the air duct structure is communicated to the dust bag, an inner surface of the annular arc part abuts against one side of the rotating support facing away from the dust bag.

In one possible embodiment, an inclined direction of the inclined plane faces toward the opening, and a first preset angle $\theta$ is formed between one end surface of the air duct close to the accommodating cavity and the inclined plane, which meets: $4° \leq \theta \leq 5°$.

In one possible embodiment, the dust collecting device further comprises an installing support, the installing support is provided in the accommodating cavity, and one end of the rotating support is rotatably provided on the installing support, a guide part is provided on a cavity wall of the accommodating cavity, and a sliding part is provided on the installing support, and the sliding part is slidably connected with the guide part, so that the installing support is detachably connected to the accommodating cavity.

In one possible embodiment, a position-limit part is provided on the installing support, and a snapping part cooperating with the position-limit part is provided at a position of the rotating support facing away from the rotating fulcrum, the rotating support is snapped on the installing support through the snapping part, so as to restrict the rotation of the rotating support around the rotating fulcrum in a direction away from the air duct structure.

In one possible embodiment, an abutting part is provided on one side of the rotating support facing away from the dust bag, and the abutting part is in a conical shape, and the abutting part is made of a soft material, and a conical groove is provided on the cavity wall of the accommodating cavity close to the installing support, when the air duct structure is communicated with the dust bag, one end of the abutting part away from the rotating support abuts against a groove wall of the conical groove.

In one possible embodiment, the cover body comprises a cover main body and a rotating part, the pushing component is provided on the cover main body, and the rotating part is in a hook shape, one end of the rotating part is connected to the cover main body, and the other end of the rotating part is rotatably connected to the machine shell, when the cover body rotates around rotation axis thereof to a second preset angle, the cover main body makes the air duct structure communicated with the dust bag through the pushing component.

In one possible embodiment, the cover body is a sliding pull plate, the pushing component is provided on the sliding pull plate, and an opening groove is provided on a surface of the machine shell, the opening groove penetrates through the opening, the sliding pull plate is slidably connected to the opening groove, and when the sliding pull plate moves to a preset distance relative to the opening groove, the sliding pull plate makes the air duct structure communicated with the dust bag through the pushing component.

In one possible embodiment, the dust collecting device further comprises a bottom shell, the bottom shell is connected with the machine shell, and a dust inlet is provided on the bottom shell, an air duct cavity is formed between the bottom shell and the machine shell, the air duct structure is located in the air duct cavity, and the air duct structure is communicated with the dust inlet.

In addition, the present disclosure also provides a cleaning base station, which comprises the dust collecting device described in any one of the above embodiments.

In addition, the present disclosure also provides a robot cleaning system, which comprises the dust collecting device described in any one of the above embodiments and a robot-cleaner.

Beneficial effects of the present disclosure are as follows.

The present disclosure discloses a dust collecting device, which includes a machine shell, a cover body, an air duct structure, a rotating support and a dust bag, wherein an accommodating cavity is formed in the machine shell, an opening communicated with the accommodating cavity is provided on the machine shell, the cover body is movably connected with the machine shell for closing the opening, and a pushing component is arranged on the cover body. The air duct structure is provided in the machine shell, a dust outlet of the air duct structure is communicated with the accommodating cavity, the rotating support is provided in the accommodating cavity, one end of the rotating support is a rotating fulcrum, and the dust bag is located in the accommodating cavity and installed on the rotating support, when the cover body closes the opening, the pushing component of the cover body drives the rotating support to rotate around the rotating fulcrum thereof, so that a part of the dust outlet is located in the dust bag to achieve the air duct structure communicating with the dust bag.

The dust collecting device provided by the present disclosure drives the rotating support installed with the dust bag to rotate through the pushing component on the cover body, so that the dust bag approaches the air duct structure to realize that the dust bag is communicated with the air duct structure. On the one hand, the dust bag is a movable component, and the air duct structure is in a fixed state, compared with the air duct structure being a movable component in the prior art, the air duct structure in the present disclosure occupies less space, thereby increasing the occupiable space of the dust bag; on the other hand, the dust bag is enabled to be communicated and sealed with the air duct structure through the rotating support, which has no problem of airtightness of the air duct structure itself.

BRIEF DESCRIPTION OF DRAWINGS

In order to more clearly illustrate the technical solutions of embodiments in the present disclosure, drawings which need to be used in the embodiments will be introduced briefly below, it should be understood that the drawings in the following description merely show some embodiments of the present disclosure, therefore, they should not be regarded as a limitation of the scope, and those ordinarily skilled in the art still could obtain other relative drawings in light of these drawings, without using any inventive efforts.

DESCRIPTION OF REFERENCE SIGNS OF MAIN COMPONENTS

Figure 1:
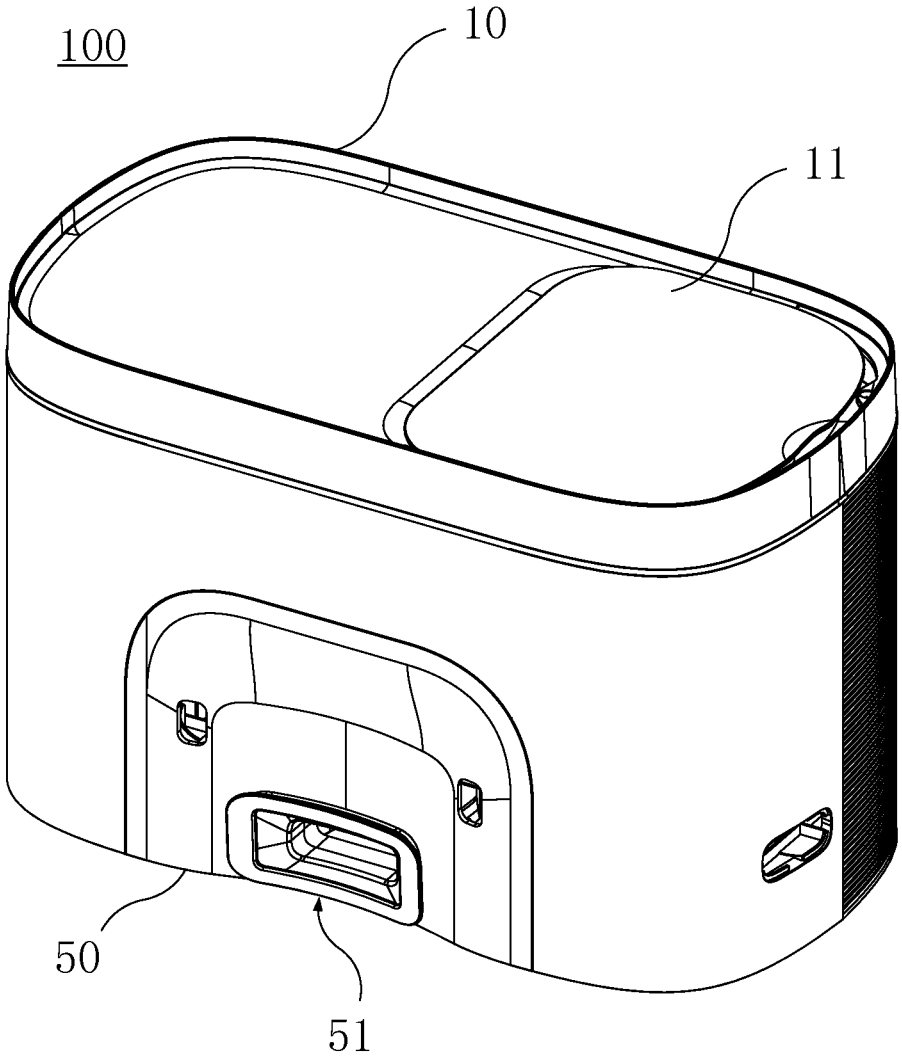
FIG. 1 shows a schematic view of an overall structure of a dust collecting device in some embodiments.

100—dust collecting device; 10—machine shell; 11—cover body; 111—cover main body; 112—pushing component; 113—rotating part; 12—opening; 13—accommodating cavity; 131—guide part; 20—air duct structure; 21—air duct; 22—butt-jointed component; 221—connecting part; 2211—inclined plane; 222—dust outlet pipe; 2221—dust outlet; 223—annular arc part; 30—rotating support; 31—plate-shaped structure; 32—snapping part; 33—abutting part; 34—installation snapping groove; 35—bending guide part; 36—anti-collision rubber pad; 37—C-shaped component; 40—installing support;

41—support body; 42—position-limit part; 43—rotating shaft; 44—sliding part; 50—bottom shell; 51—dust inlet; 60—air duct cavity.

DETAILED DESCRIPTION OF EMBODIMENTS

Embodiments of the present disclosure are described in detail below, examples of embodiments are illustrated in the drawings, wherein the same or similar reference numerals refer to the same or similar elements or elements having the same or similar functions throughout. The embodiments described below with reference to the drawings are exemplary and are only used to explain the present disclosure, but should not be construed as a limitation on the present disclosure.

In the description of the present disclosure, it should be understood that orientation or positional relations indicated by terms such as "center", "longitudinal", "lateral", "length", "width", "thickness", "upper", "lower", "front", "back", "left, "right", "vertical, "horizontal", "top", "bottom", "inner", "outer", "clockwise", "counterclockwise", "axial", "radial", "circumferential" are based on orientation or positional relations as shown in the drawings, merely for facilitating the description of the present disclosure and simplifying the description, rather than indicating or implying that related devices or elements have to be in the specific orientation, or configured or operated in a specific orientation, therefore, they should not be construed as limitations on the present disclosure.

Besides, terms "first" and "second" are merely for descriptive purpose, but should not be construed as indicating or implying importance in relativity or implying the number of indicated technical features. Thus, a feature defined as "first" and "second" may expressly or implicitly include one or more of the features. In the description of the present disclosure, "plurality" means two or more, unless otherwise expressly and specifically defined.

In the present disclosure, unless otherwise definitely specified and limited, the terms "mount", "link", "connect" and "fix" should be understood in a broad sense. For example, they can be fixed connection, detachable connection or integrated connection; they can be mechanical connection or electrical connection; they can be directly attached or indirectly attached by intermediate medium. Connection can be the internal communication between two components or interaction relationship between two components. For those ordinarily skilled in the art, the specific meaning of the above terms in the present disclosure can be understood according to the specific situation.

In the present disclosure, unless otherwise definitely specified and limited, a first feature "on" or "under" a second feature may be in direct contact with the first and second features, or the first and second features are indirectly contacted through intermediate medium. Furthermore, the first feature being "above", "over" and "up" the second feature may mean that the first feature is directly above or obliquely above the second feature, or merely represents that horizontal height of the first feature is higher than that of the second feature. The first feature being "below", "under" and "down" the second feature may mean that the first feature is directly or obliquely below the second feature, or merely represents that the horizontal height of the first feature is smaller than that of the second feature.

Embodiment 1

Figure 2:
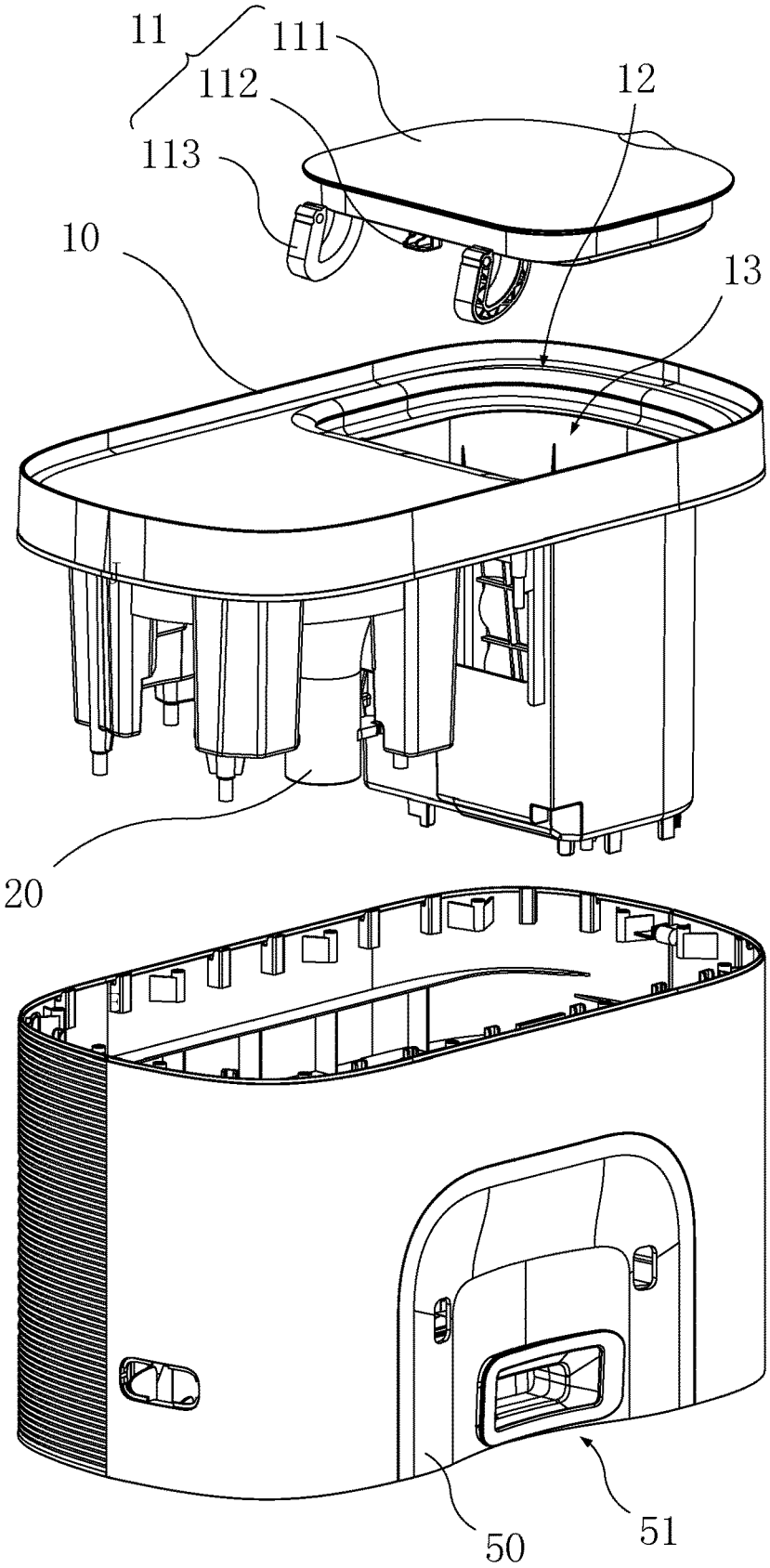
FIG. 2 shows an exploded view of a first structure of the dust collecting device in some embodiments.

Referring to FIG. 1 and FIG. 2, Embodiment 1 of the present disclosure provides a dust collecting device 100, which belongs to the technical field of cleaning equipment, and is mainly used in a cleaning base station to realize dust recovery of a cleaning robot.

Figure 7:
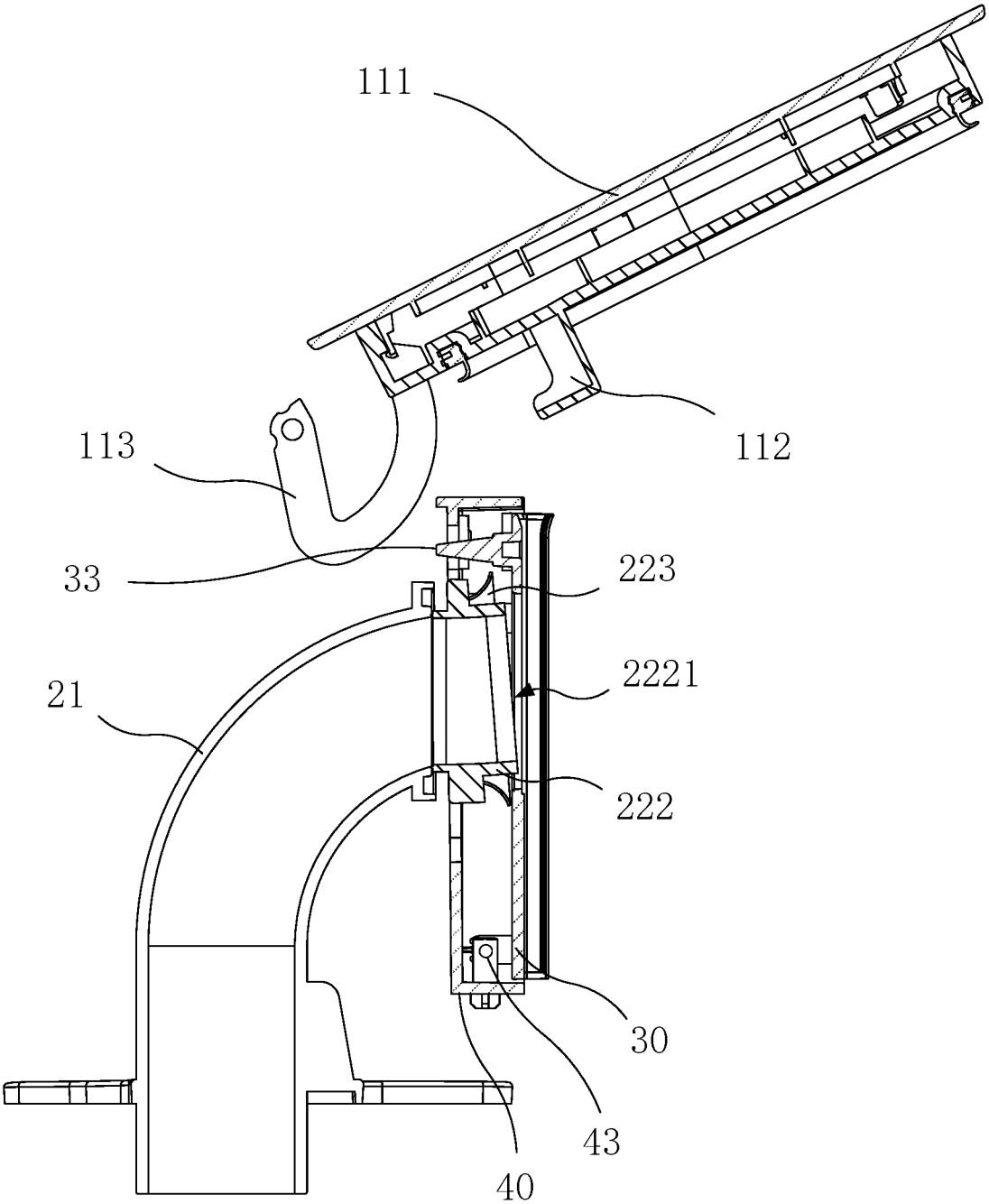
FIG. 7 shows a structural schematic view of a cover body of the dust collecting device being in an open state in some embodiments.
Figure 8:
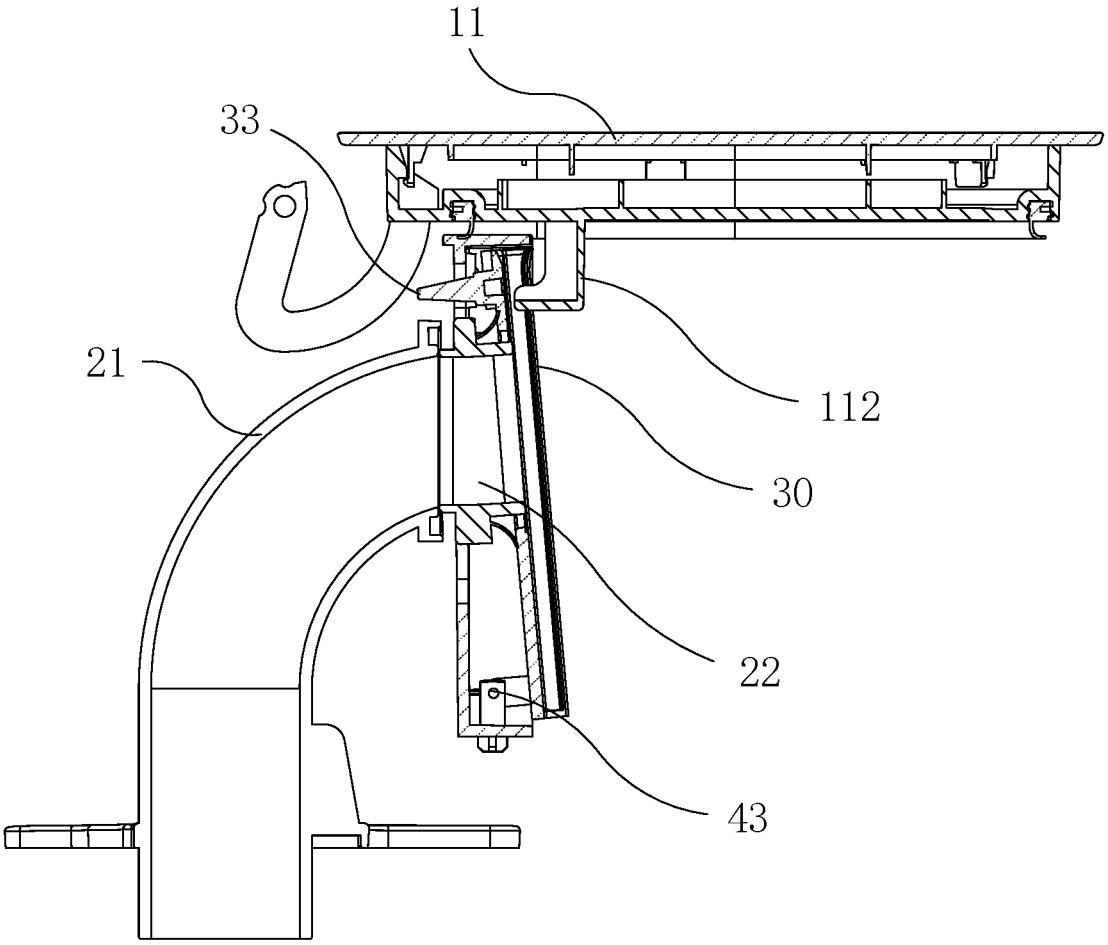
FIG. 8 shows a structural schematic view of the cover body of the dust collecting device being in a closed state in some embodiments.

Referring to FIG. 2, FIG. 7 and FIG. 8, the dust collecting device 100 provided in this embodiment includes a machine shell 10, a cover body 11, an air duct structure 20, a rotating support 30 and a dust bag, wherein an accommodating cavity 13 is formed in the machine shell 10, an opening 12 communicated with the accommodating cavity 13 is provided on the machine shell 10, the cover body 11 is movably connected with the machine shell 10 for closing the opening 12, and a pushing component 112 is arranged on the cover body 11. The air duct structure 20 is provided in the machine shell 10, a dust outlet 2221 of the air duct structure 20 is communicated with the accommodating cavity 13, the rotating support 30 is provided in the accommodating cavity 13, one end of the rotating support 30 is a rotating fulcrum, and the dust bag is located in the accommodating cavity 13 and installed on the rotating support 30.

When the cover body 11 closes the opening 12, the pushing component 112 of the cover body 11 drives the rotating support 30 to rotate around the rotating fulcrum thereof, so that a part of the dust outlet 2221 is located in the dust bag to achieve the air duct structure communicating 20 with the dust bag.

Figure 11:
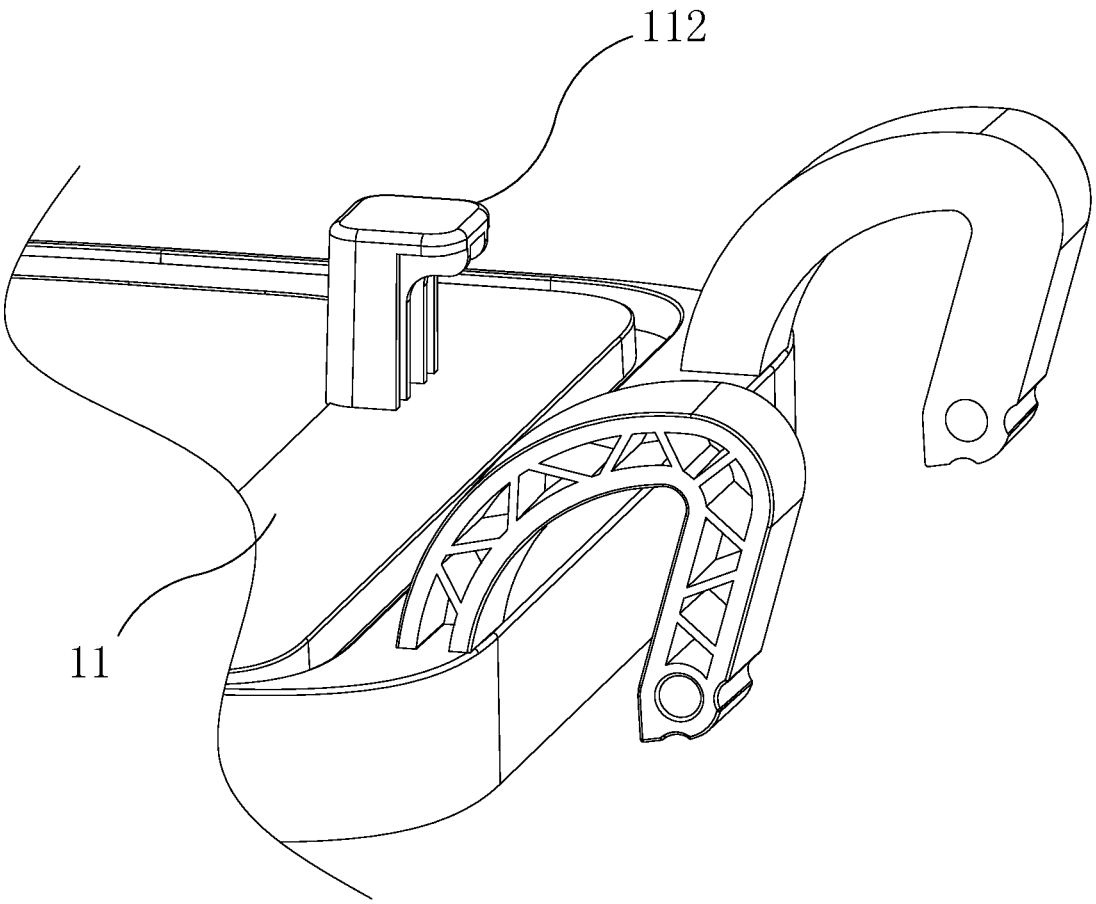
FIG. 11 shows a structural schematic view of a first embodiment of a pushing component in some embodiments.

Referring to FIG. 7, FIG. 8 and FIG. 11, in this embodiment, the pushing component 112 is preferably an L-shaped component, one end of the L-shaped component is connected to the cover body 11, and the other end may abut against the rotating support 30 for exerting an acting force to the rotating support 30, so that the rotating support 30 rotates.

Figure 12:
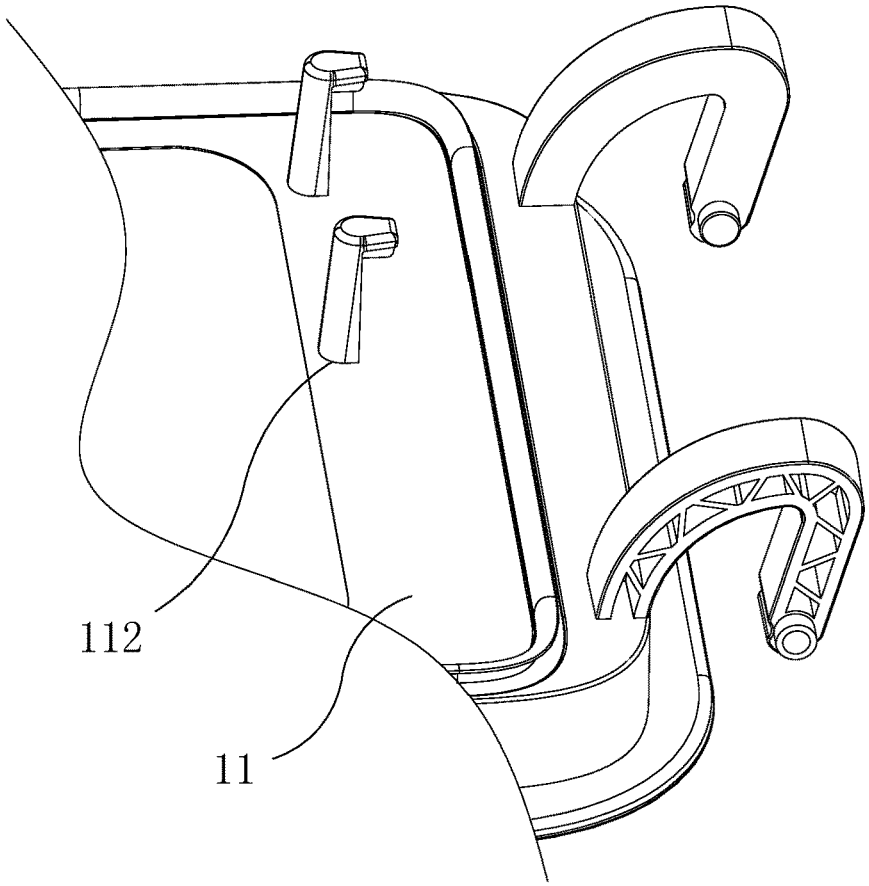
FIG. 12 shows a structural schematic view of a second embodiment of the pushing component in some embodiments.

Referring to FIG. 12, in addition to the above-mentioned L-shaped component, the structure of the pushing component 112 may also be a "7"-shaped (i.e., a shape of character "7") component. Optionally, two "7"-shaped components are provided, when the cover body 11 completely closes the opening 12, one end of the two 7-shaped components away from the cover body 11 abuts against the rotating support and can also exert an acting force on the rotating support 30.

Figure 13:
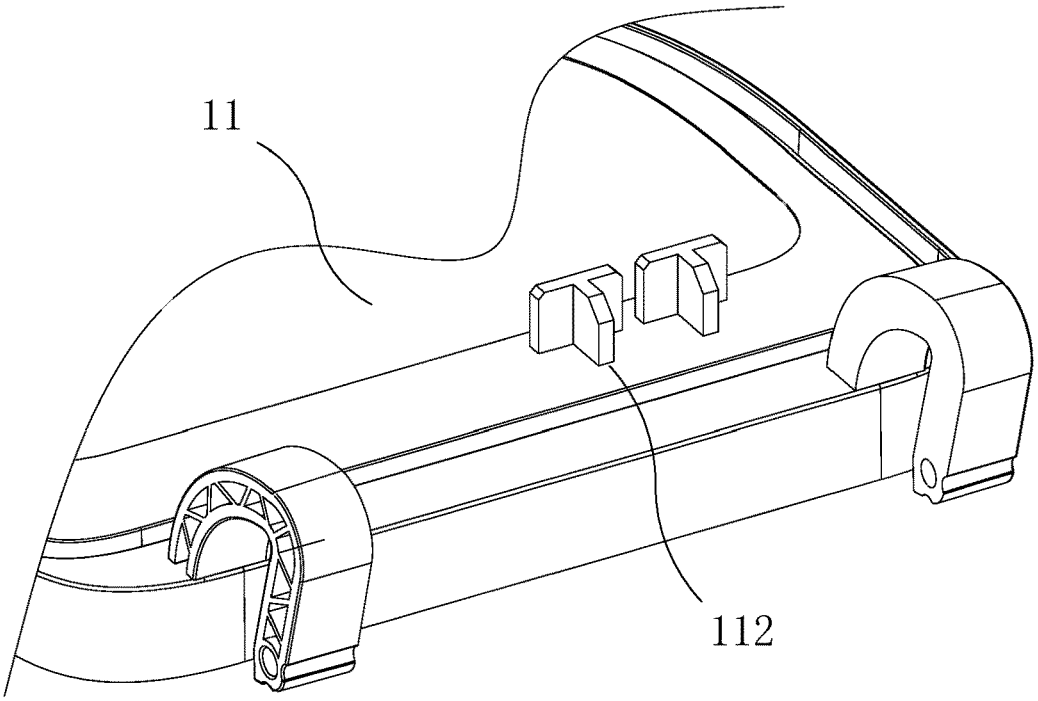
FIG. 13 shows a structural schematic view of a third embodiment of the pushing component in some embodiments.

Referring to FIG. 13, the pushing component 112 may also be a "T"-shaped component. Optionally, two "T"-shaped components are provided, and the effect achieved is the same as that of the above two pushing components 112, which will not be repeated here.

It should be noted that the number of the pushing components 112 is not limited to one or two, and the number of pushing components 112 may also be three, four, five, six, etc. according to different requirements.

In this embodiment, optionally, the rotating support 30 is a plate-shaped structure 31, installation snapping grooves 34 are formed on two opposite sides of the plate-shaped structure 31, and a bending guide part 35 is formed at one end of the installation snapping groove 34 close to the opening 12, and the bag mouth of the dust bag is slidably connected to the installation snapping groove 34 under the guidance of the bending guide part 35, thereby realizing the detachable connection between the dust bag and the rotating support 30. In the above, the bending guide part 35 plays a guiding role for the installation of the dust bag, that is, the bending guide part 35 improves the error tolerance of the installation of the dust bag, thereby improving the installation efficiency of the dust bag.

Referring specifically to FIG. 7 and FIG. 8, when the dust collecting device 100 of this embodiment is used, during the process of closing the opening 12 by the cover body 11, the cover body 11 drives the pushing component 112 thereof to move, so that the pushing component 112 drives the rotating support 30 installed with the dust bag to rotate around the rotating fulcrum thereof, so as to make the dust bag approach the air duct structure 20, when the cover body 11 completely closes the opening 12, a part of the dust outlet 2221 of the air duct structure 20 is accommodated in the dust bag, thereby realizing the communication and sealing between the air duct structure 20 and the dust bag.

In the prior art, a dust collecting barrel generally includes an air duct and a dust bag, and the air duct is divided into two parts, which are respectively a fixed air duct and a movable air duct, wherein the movable air duct may rotate around a rotating shaft, and the communication and sealing with the movable air duct are always maintained during the rotation. After the dust bag is loaded into the dust collecting barrel, the movable air duct is driven to rotate by a specific mechanical device, so that the movable air duct is inserted into the dust bag, so as to realize the communication and sealing between the dust bag and the air duct. However, this design method has two defects: in the first aspect, the dust collecting barrel needs to reserve enough space for the movable air duct to rotate, thereby reducing the available space of the dust bag, that is, reducing the capacity of the dust bag; in the second aspect, the movable air duct need always be in a communicated and sealed state with the fixed air duct during the rotation process, and the structural strength of the connection position between the fixed air duct and the movable air duct needs to be ensured, which increases the difficulty of design.

However, in this embodiment, the rotating support 30 is pushed to rotate by the pushing component 112, so that the dust bag installed on the rotating support 30 approaches toward the direction of the air duct structure 20 until part of the dust outlet 2221 of the air duct structure 20 is accommodated in the dust bag, thereby achieving the communication and sealing between the dust bag and the air duct structure 20. It is easy to understand that the air duct structure 20 in this embodiment is always in a static state, that is, the air duct structure 20 is fixed, and the dust bag can approach the air duct structure 20 along with the rotating support 30 under the force of the pushing component 112 of the cover body 11, that is, the dust bag is a movable component, so as to avoid the movement of the air duct structure 20, thereby reducing the internal space of the machine shell 10 occupied due to the movement of the air duct structure 20, and the saved space can be used to increase the occupied space of the dust bag, that is, to increase the capacity of the dust bag.

In addition, during the process from separation to communication between the air duct structure 20 and the dust bag, the air duct structure 20 has better airtightness, and when communicated, a part of the air duct structure 20 can extend into the accommodating space of the dust bag, therefore, the airtightness between the dust bag and the air duct structure 20 is better, thereby preventing dust from falling from the air duct structure 20 itself and from the communication position between the air duct structure 20 and the dust bag.

Figure 9:
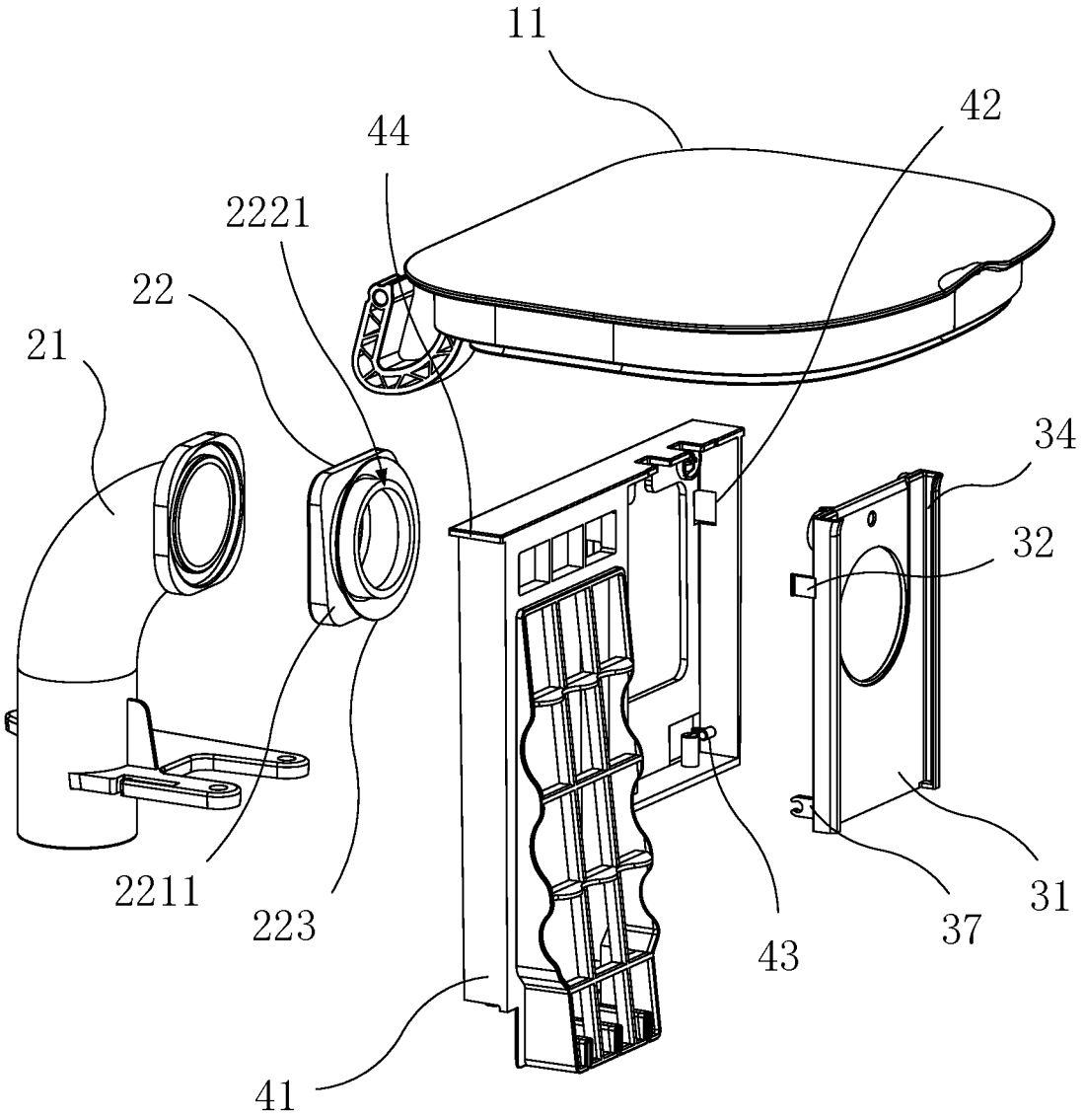
FIG. 9 shows an exploded view of a second structure of the dust collecting device in some embodiments.
Figure 10:
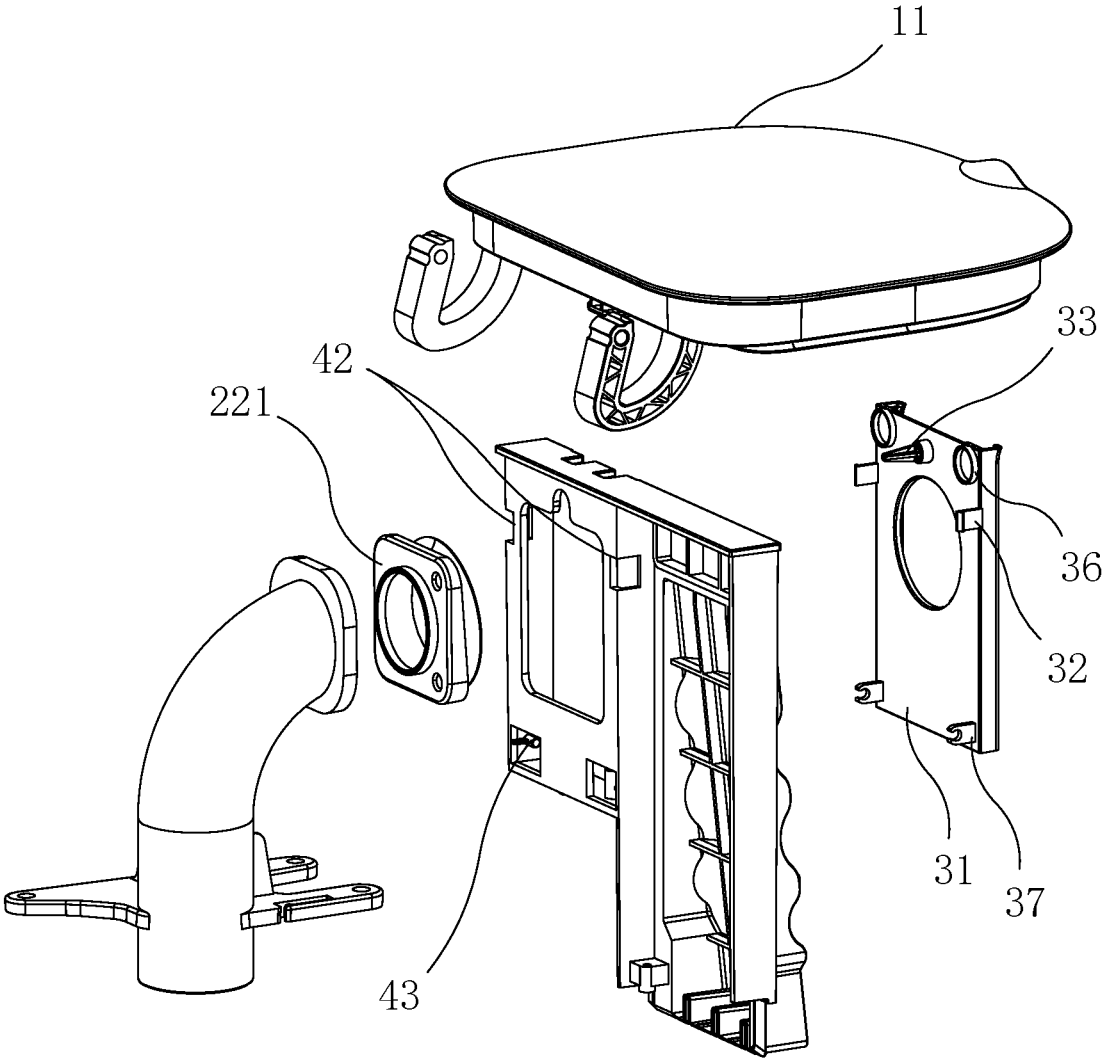
FIG. 10 shows an exploded view of a third structure of the dust collecting device in some embodiments.

Referring to FIG. 9 and FIG. 10, in some implementations of the present embodiment, the air duct structure 20 includes an air duct 21 and a butt-jointed component 22, the butt-jointed component 22 includes a connecting part 221 and a dust outlet pipe 222, the connecting part 221 is connected to the air duct 21, one side of the connecting part 221 facing away from the air duct 21 is an inclined plane 2211, the dust outlet pipe 222 is vertically provided on the inclined plane 2211, one end of the dust outlet pipe 222 is the dust outlet 2221, and the other end of the dust outlet pipe 222 is communicated with the air duct 21, an annular arc part 223 is provided in a circumferential direction of the dust outlet pipe 222, and the dust outlet 2221 protrudes from the annular arc part 223, when the air duct structure 20 is communicated with the dust bag, an inner surface of the annular arc part 223 abuts against one side of the rotating support 30 facing away from the dust bag.

In this embodiment, the dust outlet pipe 222 is perpendicular to the inclined plane 2211 of the connecting part 221, so that the dust outlet pipe 222 may be provided obliquely relative to the air duct 21, which is convenient for the dust outlet pipe 222 to cooperate with the rotating support 30 installed with the dust bag.

The annular arc part 223 is provided in a circumferential direction of the dust outlet pipe 222, and the annular arc part 223 is in a shape of a "bell mouth". The annular arc part 223 is vertically provided on the inclined plane 2211, that is, the gradient of the annular arc part 223 is the same as that of the dust outlet pipe 222. The annular arc part 223 is used to wrap the dust outlet pipe 222, and the dust outlet 2221 of the dust outlet pipe 222 protrudes from the annular arc part 223, when the dust outlet 2221 of the dust outlet pipe 222 extends into the dust bag, the inner surface of the annular arc part 223 abuts against the rotating support 30, so as to seal the communication position between the dust outlet pipe 222 and the dust bag.

In some specific embodiments, the annular arc part 223 is made of soft material, and the inner surface of the annular arc part 223 is provided with an electrostatic layer, which is used to increase the adsorbability of the inner surface of the annular arc part 223, so as to improve the compactness between the annular arc part 223 and the rotating support 30 and achieve better sealing effect.

Figure 4:
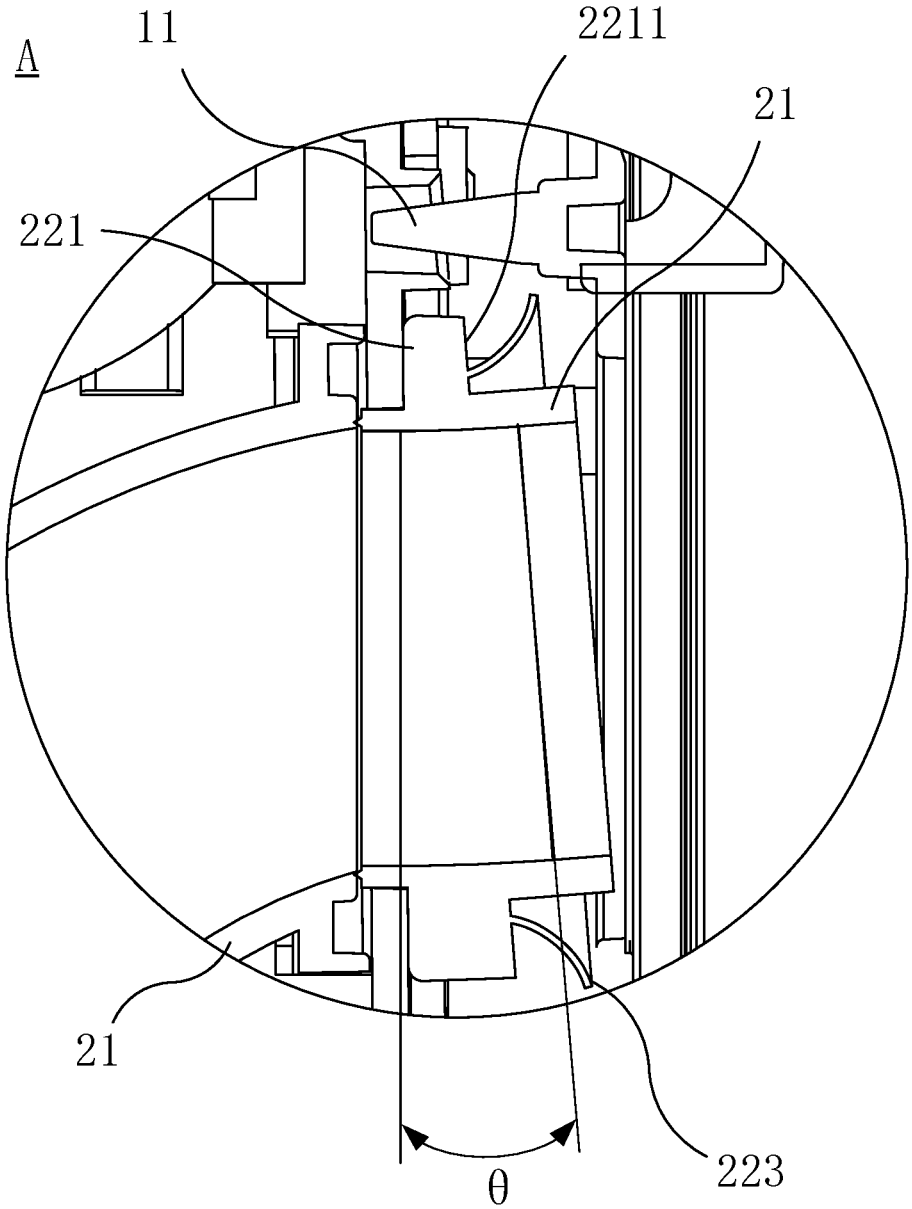
FIG. 4 shows a partial enlarged schematic view of A part in FIG. 3.

Referring to FIG. 4, on the basis of the above-mentioned embodiments, an inclined direction of the inclined plane 2211 faces toward the opening 12, and a first preset angle θ is formed between one end surface of the air duct 21 close to the accommodating cavity 13 and the inclined plane 2211, which meets: $4° \leq \theta \leq 5°$.

In this embodiment, the inclined direction of the inclined plane 2211 faces toward the opening 12, that is, the inclined plane 2211 is inclined upward. It is easy to understand that the rotation method of the rotating support 30 and the inclined arrangement of the inclined plane 2211 not only ensure the compactness of surface between the annular arc part 223 and the rotating support 30, but also ensure that when the cover body 11 is opened to separate the dust outlet pipe 222 from the dust bag, the inclined dust outlet pipe 222 can enable the dust remaining at a position of the dust outlet 2221 of the dust outlet pipe 222 to have a trend of moving toward the inside of the dust outlet pipe 222, thereby preventing the dust from sliding out of the dust outlet 2221 and falling into the inside of the machine shell 10.

Exemplarily, the first preset angle θ formed between one end surface of the air duct 21 close to the accommodating cavity 13 and the inclined plane 2211 may be set to be 4°, 4.2°, 4.5°, 4.8°, 5°, and the like.

It is easy to understand that if the first preset angle θ is too large, the moving space occupied by the rotating support 30 will be larger; if the first preset angle θ is too small, the risk of dust falling into the machine shell 10 from the dust outlet 2221 will increase.

In some specific embodiments, a first preset angle θ formed between one end surface of the air duct 21 close to the accommodating cavity 13 and the inclined plane 2211 is 4.5°. The value of the first preset angle θ is selected by comprehensively considering the contradiction between the moving space and the dust prevention of the rotating support 30, so as to ensure that the rotating support 30 has smaller moving space, and the dust outlet pipe 222 has a certain ability of preventing dust from falling to the outside from the dust outlet 2221.

Figure 5:
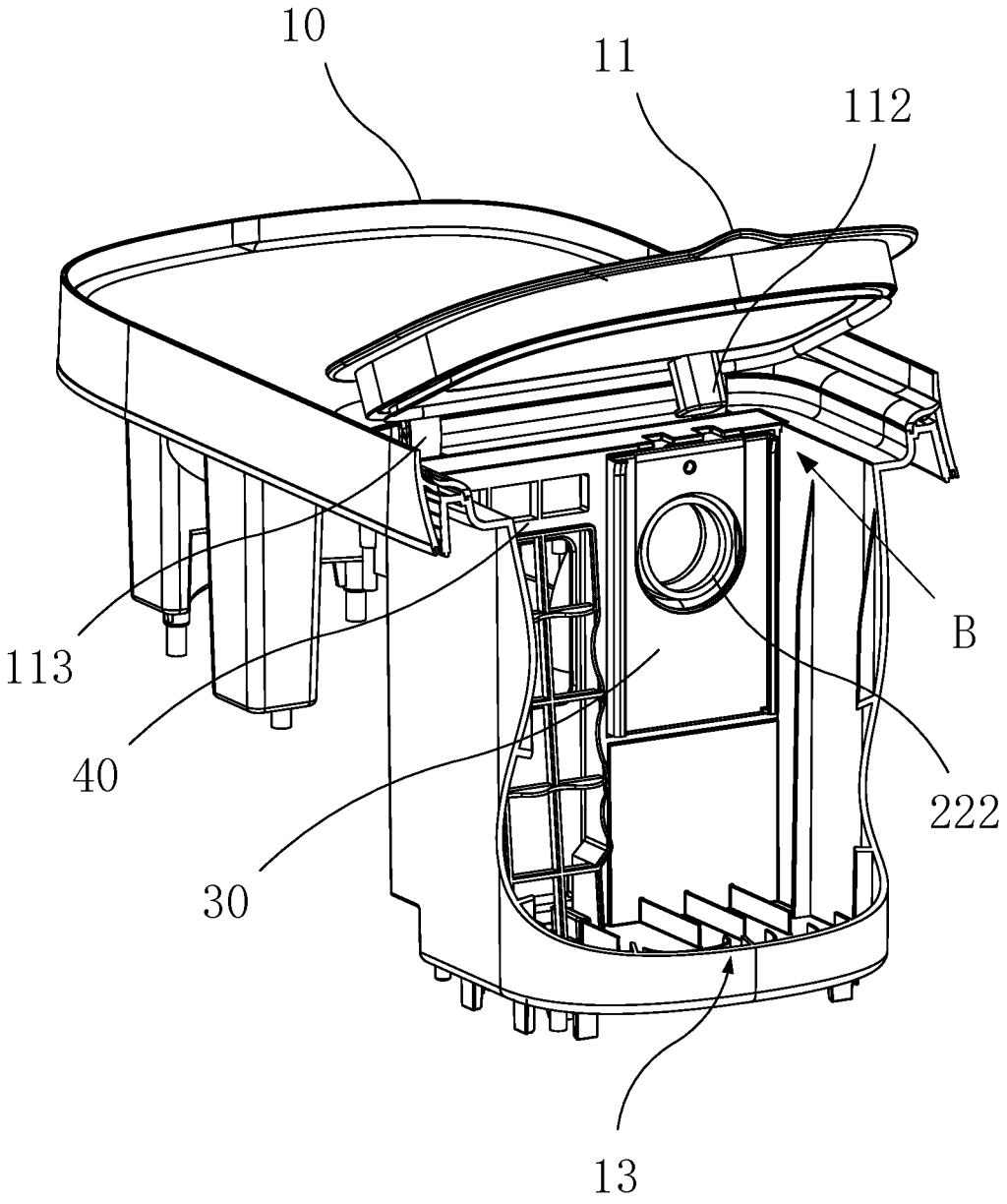
FIG. 5 shows a schematic view of an internal structure of a machine shell in the dust collecting device in some embodiments.
Figure 6:
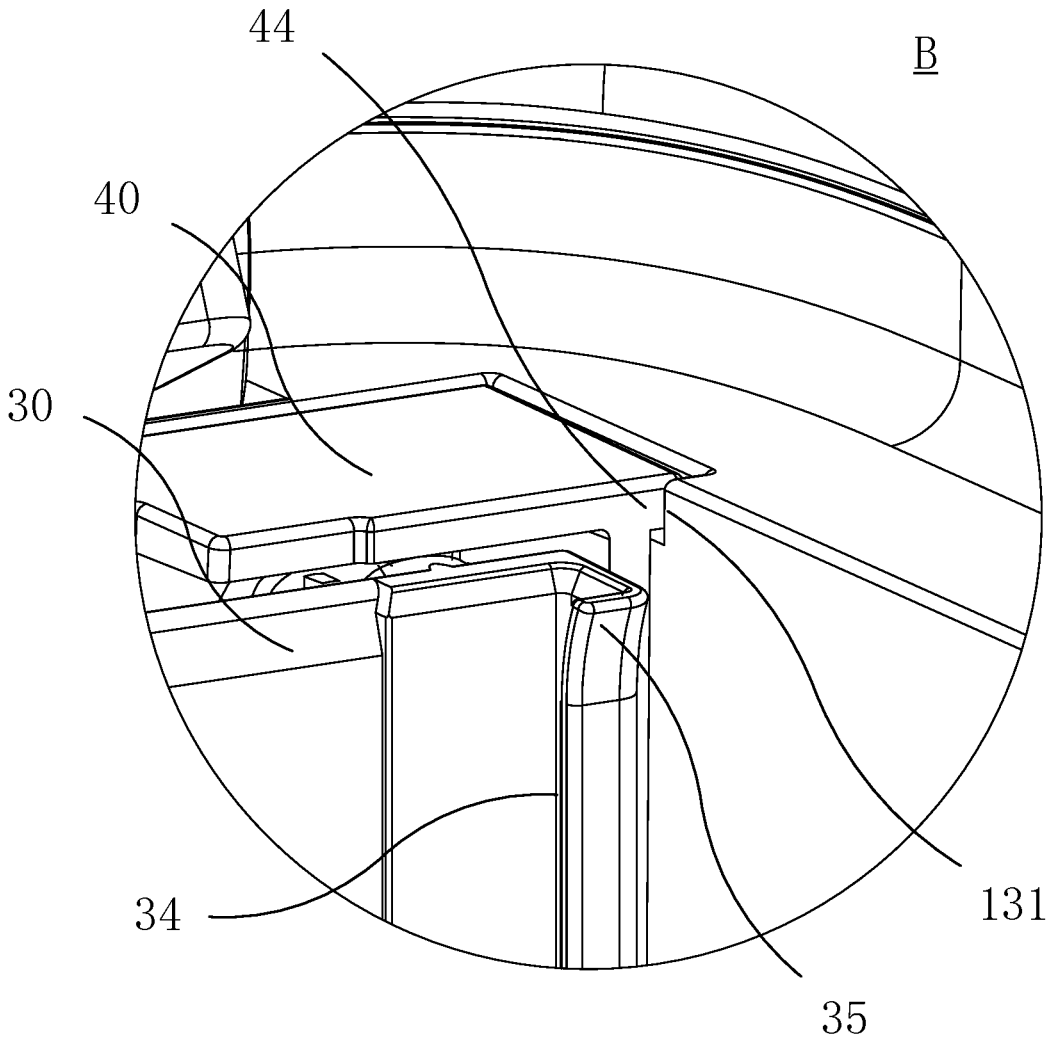
FIG. 6 shows a partial enlarged schematic view of B part in FIG. 5.

Referring to FIG. 5 to FIG. 7, in some implementations of the present embodiment, the dust collecting device 100 further includes an installing support 40, the installing support 40 is provided in the accommodating cavity 13, and one end of the rotating support 30 is rotatably provided on the installing support 40, and a guide part 131 is provided on the cavity wall of the accommodating cavity 13, a sliding part 44 cooperating with the guide part 131 is provided on the installing support 40, the sliding part 44 is slidably connected to the guide part 131, so that the installing support 40 is detachably connected to the accommodating cavity 13.

In this embodiment, specifically, the guide part 131 of the accommodating cavity 13 is a plug-in groove, the sliding part 44 of the installing support 40 is a plug-in board, and the installing support 40 includes a support body 41 and the plug-in board, the two plug-in boards are provided on two opposite edge parts of the support body 41, and the plug-in boards can be slidably inserted into the plug-in grooves, thereby realizing the detachable connection between the installing support 40 and the accommodating cavity 13. The user can disassemble the installing support 40, and then install the dust bag on the rotating support 30 rotatably connected with the installing support 40, before the installing support 40 is inserted into the accommodating cavity 13 through the plug-in groove. This detachable structure improves the disassembly and replacement efficiency of the dust bag.

Two C-shaped components 37 are provided on the rotating support 30, and a rotating shaft 43 cooperating with the C-shaped component 37 is provided on the installing support 40, and the rotating support 30 rotates around the rotating shaft 43 through the C-shaped component 37, so that the dust bag is communicated with the air duct structure 20.

Further, reinforcing ribs are also provided between the rotating shaft 43 and the installing support 40, and the reinforcing ribs are respectively connected with the installing support 40 and the rotating shaft 43, so as to improve the structural strength of the rotating shaft 43, so that the rotating process of the rotating support 30 is more reliable and the service life is longer.

It should be understood that the above only exemplifies a rotational connection structure between the rotating support 30 and the installing support 40, and in other specific embodiments, one end of the rotating support 30 may also be provided on the installing support 40 in a manner of hinged connection, or through rotational connection between the gear assembly and the installing support 40, the rotation of the rotating support 30 can be achieved, which is not specifically limited here.

In another embodiments, a sliding part 44 is provided on the cavity wall of the accommodating cavity 13, a guide part 131 is provided on the installing support 40, and the sliding part 44 is slidably connected with the guide part 131, so that the installing support 40 is detachably connected to the machine shell 10. This design method is similar in structure to that of the above-mentioned embodiment, and can also realize the detachable connection of the installing support 40, which will not be repeated here.

Referring to FIG. 9 and FIG. 10, on the basis of the above-mentioned embodiments, a position-limit part 42 is provided on the installing support 40, and a snapping part 32 cooperating with the position-limit part 42 is provided at a position of the rotating support 30 away from the rotating fulcrum, the rotating support 30 is snapped on the installing support 40 through the snapping part 32, so as to restrict the rotation of the rotating support 30 around the rotating fulcrum in a direction away from the air duct structure 20.

In this embodiment, specifically, the position-limit part 42 on the installing support 40 is a snapping groove, the snapping part 32 on the rotating support 30 is a fastener, and the rotating support 30 is snapped on the installing support 40 through the fastener, and the snapping groove can limit the rotation of the rotating support 30 around the rotating fulcrum in a direction away from the air duct structure 20.

It should be noted that the snapping groove restricts the rotation of the rotating support 30 around the rotating fulcrum in a direction away from the air duct structure but does not restrict the rotation of the rotating support 30 around the rotating fulcrum in a direction close to the air duct structure 20, that is, does not hinder the rotating support 30 from continuing to approach the air duct structure 20 after the fastener is snapped, so as to realize the communication and sealing of the dust bag and the air duct structure 20.

Referring to FIG. 10, on the basis of the above-mentioned embodiments, an abutting part 33 is provided on one side of the rotating support 30 facing away from the dust bag, and the abutting part 33 is in a conical shape, and the abutting part 33 is made of a soft material, and a conical groove is provided on the cavity wall of the accommodating cavity 13 close to the installing support 40, when the air duct structure 20 is communicated with the dust bag, one end of the abutting part 33 away from the rotating support 30 abuts against a groove wall of the conical groove.

In this embodiment, the arrangement of the abutting part 33 and the conical groove facilitates the positioning of the rotation angle of the rotating support 30, and the abutting part 33 is made of a soft material, and the abutting part 33 abuts against the groove wall of the conical groove, thereby playing a buffering role to avoid rigid collision between the rotating support 30 and the air duct structure 20.

Referring to FIG. 10, in some implementations of the present embodiment, an anti-collision rubber pad 36 is provided on one side of the rotating support 30 facing away from the dust bag, when the air duct structure 20 is communicated with the dust bag, the anti-collision rubber pad 36 abuts against the surface of installing support 40.

In this embodiment, the arrangement of the anti-collision rubber pad 36 plays a buffering role when the rotating support 30 is contacted with the installing support 40, so as to avoid the rigid collision between the rotating support 30 and the installing support 40 during the rotation process.

Figure 3:
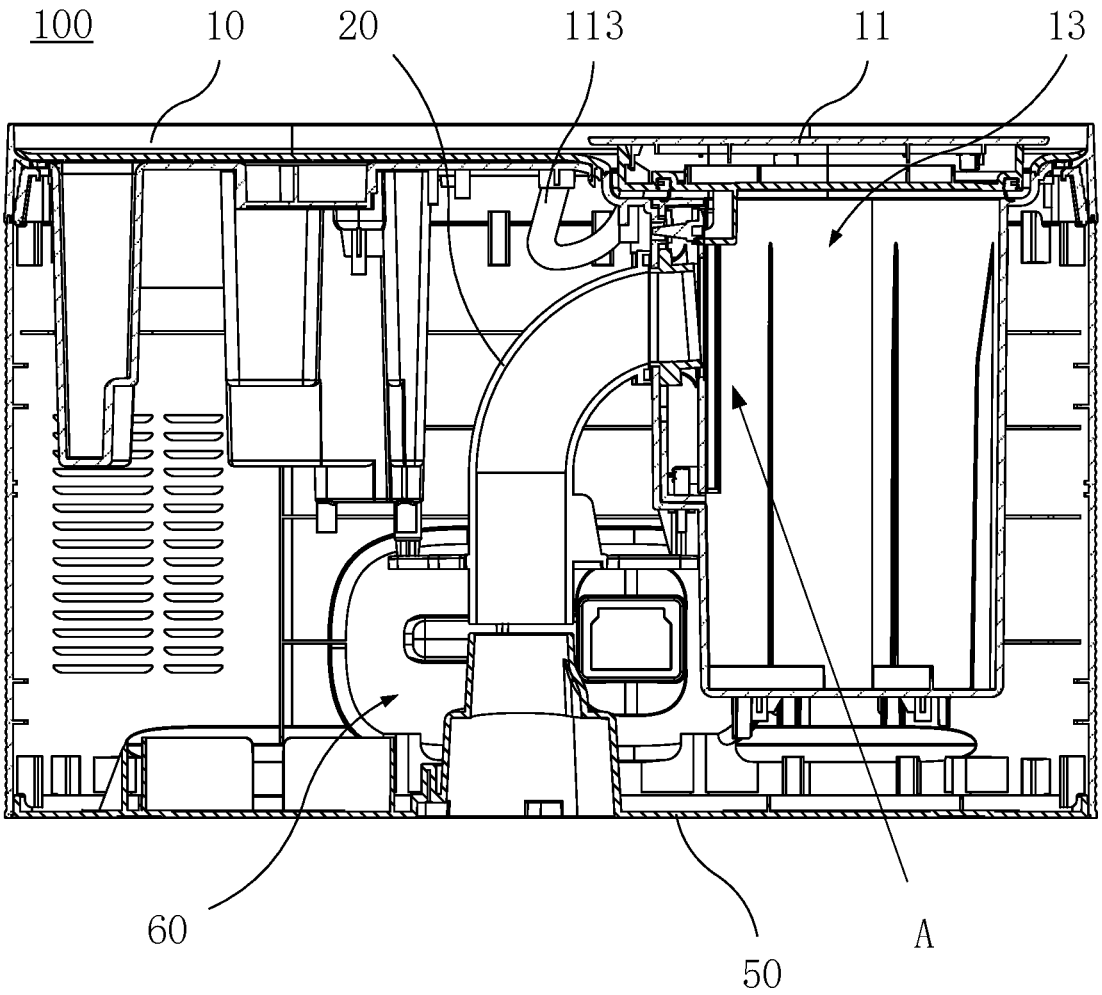
FIG. 3 shows a structural sectional view of the dust collecting device in some embodiments.

Referring to FIG. 2 and FIG. 3, in some implementations of the present embodiment, the dust collecting device 100 further comprises a bottom shell 50, the bottom shell 50 is connected with the machine shell 10, and a dust inlet 51 is provided on the bottom shell 50, an air duct cavity 60 is formed between the bottom shell 50 and the machine shell 10, the air duct structure 20 is located in the air duct cavity 60, and the air duct structure 20 is communicated with the dust inlet 51.

In this embodiment, the dust outlet 2221 may be directly butt-jointed to the cleaning robot, or may be connected to the internal structure of the cleaning base station. The dust and dirt, etc. stored in the dust box of the cleaning robot can enter the air duct structure 20 through the dust outlet 2221, and enter the dust bag through the air duct structure 20, thereby realizing dust recovery.

Referring to FIG. 7 and FIG. 8, in some implementations of the present embodiment, the cover body 11 comprises a cover main body 111 and a rotating part 113, the pushing component 112 is provided on the cover main body 111, and the rotating part 113 is in a hook shape, one end of the rotating part 113 is connected to the cover main body 111, and the other end of the rotating part 113 is rotatably connected to the machine shell 10, when the cover body 11 rotates around rotation axis thereof to a second preset angle, the cover main body 111 makes the air duct structure 20 communicated with the dust bag through the pushing component 112.

In this embodiment, the cover body 11 corresponding to the second preset angle completely closes the opening 12 of the machine shell 10, that is, the cover body 11 is in a closed state. During the closing process, the pushing component 112 drives the rotating support 30 to send the dust bag to the position of the air duct structure 20, thereby realizing the communication between the dust bag and the air duct structure 20.

In addition, the rotating part 113 is in a hook shape, one end of the rotating part 113 is connected to the cover main body 111, and the other end of the rotating part 113 is rotatably connected to the machine shell 10. During the process of opening the cover body 11, a part of the machine shell 10 may be accommodated in the accommodating space formed by the hook shape, so that the cover body 11 has larger opening and closing angles, especially during the opening process of the cover body 11, the opening 12 can be opened in a wide range or completely, so as to facilitate the user to operate the inside of the machine shell 10.

Embodiment 2

On the basis of the above-mentioned Embodiment 1, the cover body 11 is a sliding pull plate, the pushing component 112 is provided on the sliding pull plate, and an opening groove is provided on a surface of the machine shell 10, the opening groove penetrates through the opening 12, the sliding pull plate is slidably connected to the opening groove, and when the sliding pull plate moves to a preset distance relative to the opening groove, the sliding pull plate makes the air duct structure 20 communicated with the dust bag through the pushing component 112.

In this embodiment, the cover body 11 corresponding to the preset distance is in a state of safely closing the opening 12, that is, a closed state. The cover body 11 is connected to the machine shell 10 in a pulling manner to realize the closing of the opening 12. During the movement of the sliding pull plate, the pushing component 112 moves synchronously with the sliding pull plate, and the pushing component 112 drives the rotating support 30 installed with the dust bag to rotate and approach the air duct structure 20, which can also realize the communication and sealing between the air duct structure 20 and the dust bag.

Embodiment 3

On the basis of the above-mentioned Embodiment 1 and Embodiment 2, Embodiment 3 of the present disclosure provides a cleaning base station, which includes a base station body and a dust collecting device 100, and the dust collecting device 100 is installed on the base station body.

When in use, the cleaning robot drives to the cleaning base station body, so that the dust box of the cleaning robot is communicated with the dust inlet 51 of the dust collecting device 100, so as to transfer the dust and dirt in the dust box from the dust box to the dust bag of dust collecting device 100. When the dust bag is full of dust, the user can open the cover body 11, take out the installing support 40 together with the rotating support 30 rotatably connected to the installing support 40, and replace or dump the dust bag on the rotating support 30, and then put the installing support 40 back into the machine shell 10. During the closing process of the cover body 11, the pushing component 112 on the cover body 11 moves with the cover body 11, the pushing component 112 abuts against the rotating support 30 and drives the rotating support 30 installed with the dust bag to rotate around the rotating fulcrum thereof, thereby driving the dust bag to approach the air duct structure 20 until the dust outlet 2221 of the air duct structure 20 is accommodated in the dust bag, so as to realize the communication and sealing between the air duct structure 20 and the dust bag.

In the description of this specification, description with reference to the terms "one embodiment," "some embodiments," "example," "specific example," or "some examples", etc., mean that specific feature, structure, material or characteristic described in combination with the embodiment or example are included in at least one embodiment or example of the present disclosure. In this specification, schematic presentations of the above terms are not necessarily directed to the same embodiment or example. Furthermore, the specific features, structures, materials or characteristics described may be combined in any suitable manner in any one or more embodiments or examples. Furthermore, those skilled in the art may join and combine the different embodiments or examples described in this specification, as well as the features of the different embodiments or examples, without conflicting each other.

Although the embodiments of the present disclosure have been shown and described above, it should be understood that the above embodiments are exemplary and should not be construed as limitations to the present disclosure, those ordinarily skilled in the art can make changes, modifications, substitutions and alterations to the above-described embodiments within the scope of the present disclosure.

What is claimed is:

1. A dust collecting device, comprising:

a machine shell, wherein an accommodating cavity is formed in the machine shell, an opening communicated with the accommodating cavity is provided on the machine shell;

a cover body, wherein the cover body is movably connected with the machine shell for closing the opening, and a pushing component is arranged on the cover body;

an air duct structure, wherein the air duct structure is provided in the machine shell, a dust outlet of the air duct structure is communicated with the accommodating cavity, wherein the air duct structure comprises an air duct and a butt-jointed component, the butt-jointed component comprises a connecting part and a dust outlet pipe, and the connecting part is connected to the air duct, one side of the connecting part facing away from the air duct is an inclined plane, the dust outlet pipe is vertically provided on the inclined plane, one end of the dust outlet pipe is the dust outlet, and the other end of the dust outlet pipe is communicated with the air duct;

a rotating support, wherein the rotating support is provided in the accommodating cavity, one end of the rotating support is a rotating fulcrum; and a dust bag, wherein the dust bag is located in the accommodating cavity and installed on the rotating support, wherein when the cover body closes the opening, the pushing component drives the rotating support to rotate around the rotating fulcrum, so that a part of the dust outlet is located in the dust bag to achieve the air duct structure communicating with the dust bag, and wherein an annular arc part is provided in a circumferential direction of the dust outlet pipe, the annular arc part is in a shape of a "bell mouth", wherein the annular arc part is vertically provided on the inclined plane, and a gradient of the annular arc part is the same as that of the dust outlet pipe, wherein the annular arc part is used to wrap the dust outlet pipe, and wherein the dust outlet protrudes from the annular arc part, when the air duct structure is communicated with the dust bag, an inner surface of the annular arc part abuts against one side of the rotating support facing away from the dust bag, so as to seal a communication position between the dust outlet pipe and the dust bag.

2. The dust collecting device according to claim 1, wherein an inclined direction of the inclined plane faces toward the opening, and a first preset angle θ is formed between one end surface of the air duct close to the accommodating cavity and the inclined plane, which meets: $4° \leq \theta \leq 5°$.

3. The dust collecting device according to claim 1, wherein the dust collecting device further comprises an installing support, the installing support is provided in the accommodating cavity, and one end of the rotating support is rotatably provided on the installing support, a guide part is provided on a cavity wall of the accommodating cavity, and a sliding part is provided on the installing support, and the sliding part is slidably connected with the guide part, so that the installing support is detachably connected to the accommodating cavity.

4. The dust collecting device according to claim 3, wherein a position-limit part is provided on the installing support, and a snapping part cooperating with the position-limit part is provided at a position of the rotating support facing away from the rotating fulcrum, the rotating support is snapped on the installing support through the snapping part, so as to restrict a rotation of the rotating support around the rotating fulcrum in a direction away from the air duct structure.

5. The dust collecting device according to claim 4, wherein an abutting part is provided on one side of the rotating support facing away from the dust bag, and the abutting part is in a conical shape, and a conical groove is provided on a cavity wall of the accommodating cavity, when the air duct structure is communicated with the dust bag, one end of the abutting part away from the rotating support abuts against a groove wall of the conical groove.

6. The dust collecting device according to claim 1, wherein the cover body comprises a cover main body and a rotating part, the pushing component is provided on the cover main body, and the rotating part is in a hook shape, one end of the rotating part is connected to the cover main body, and the other end of the rotating part is rotatably connected to the machine shell, when the cover body rotates around rotation axis thereof to a second preset angle, the cover main body makes the air duct structure communicated with the dust bag through the pushing component.

7. The dust collector according to claim 1, wherein the cover body is a sliding pull plate, the pushing component is provided on the sliding pull plate, and an opening groove is provided on a surface of the machine shell, the opening groove penetrates through the opening, the sliding pull plate is slidably connected to the opening groove, and when the sliding pull plate moves to a preset distance relative to the opening groove, the sliding pull plate makes the air duct structure communicated with the dust bag through the pushing component.

8. The dust collecting device according to claim 1, wherein the dust collecting device further comprises a bottom shell, the bottom shell is connected with the machine shell, and a dust inlet is provided on the bottom shell, an air duct cavity is formed between the bottom shell and the machine shell, the air duct structure is located in the air duct cavity, and the air duct structure is communicated with the dust inlet.

9. A cleaning base station, comprising the dust collecting device according to claim 1.

10. A robot cleaning system, comprising the dust collecting device according to claim 1 and a robot-cleaner.

* * * * *